US005163398A

United States Patent [19]

Buslepp et al.

[11] Patent Number: 5,163,398

[45] Date of Patent: Nov. 17, 1992

[54] ENGINE IDLE SPEED CONTROL BASED UPON FUEL MASS FLOW RATE ADJUSTMENT

[75] Inventors: Kenneth J. Buslepp, Shelby Township, Macomb County; Douglas E. Trombley, Grosse Pointe; Ronald J. Sikarskie, Warren, all of Mich.

[73] Assignee: General Motors Corporation, Detroit, Mich.

[21] Appl. No.: 807,352

[22] Filed: Dec. 16, 1991

[51] Int. Cl.[5] ..... F02D 41/16

[52] U.S. Cl. ..... 123/339

[58] Field of Search ..... 123/339

[56] References Cited

U.S. PATENT DOCUMENTS 4,619,232 10/1986 Morris ..... 123/339

5,031,594 7/1991 Morikawa ..... 123/339

*Primary Examiner*—Andrew M. Dolinar

*Attorney, Agent, or Firm*—Jimmy L. Funke

[57] ABSTRACT

An idle speed regulating system is described for an internal combustion engine operating according to a fuel based control strategy, wherein the amount of fuel delivered the engine is determined directly as a function of the demand for engine output power and the amount of air supplied to the engine is controlled as a function of the quantity of delivered fuel. The system senses the actual idling rotational speed of the engine, derives a desired idling speed for the engine, and reduces the difference between the desired and actual idling speeds by adjusting the flow rate of the quantity of fuel delivered to the engine as a function of the difference between the desired and actual idling speeds. More specifically, the rate of fuel flow is adjusted in accordance with the sum of an open-loop feedforward value, a closed-loop feedback value, and preferably an adaptive learning correction value.

4 Claims, 6 Drawing Sheets

ENGINE IDLE SPEED CONTROL BASED UPON FUEL MASS FLOW RATE ADJUSTMENT

BACKGROUND OF THE INVENTION

This invention relates to an idle speed control system for an internal combustion engine, and more particularly, to a system for regulating the idling rotational speed of an engine by adjusting the mass flow rate of fuel delivered to the engine.

Recently, fuel based control strategies have been applied to fuel injected internal combustion engines for air-fuel ratio regulation. In such engines, the amount of fuel injected into each cylinder during an engine cycle is normally determined directly as a function of the operator demand for engine output, as indicated for example, by the degree of depression of an accelerator pedal. In response to the quantity of fuel injected into each cylinder, the engine intake air flow is then controlled in a closed-loop fashion to achieve the appropriate engine air-fuel ratio.

Idle speed regulation in engines operating according to a fuel based control strategies has conventionally been performed by directly adjusting the quantity of fuel injected into each cylinder during the engine cycle, since known idle control techniques based on air flow adjustment are not applicable. This is typically accomplished by employing well known proportional-integral-derivative (PID) control, or some variation thereof, to adjust the quantity of fuel injected per cylinder per cycle in accordance with the difference between the actual engine idling speed and a desired engine idling speed to reduce the difference between the desired and actual idling speeds.

In practice, the above-described approach for fuel based idle control has exhibited instability under certain engine operating conditions. It has been found that this instability results because of the nature of relationship between engine speed and the engine parameter being adjusted, i.e. the quantity of fuel injected per cylinder per cycle. This particular engine parameter does not behave in a monotonic fashion with regard to engine rotational speed. At low engine speeds, the quantity of fuel that must be injected into each cylinder to sustain a constant rotational speed initially decreases with increasing idling speed. This is due to the improved thermal efficiency and scavenging of the engine as rotational speed increases. Eventually frictional losses in the engine rise to the point where the quantity of injected fuel per cylinder then has to be increased to achieve an increase in engine speed. Due to this non-monotonic behavior, traditional idle control systems are not able to quickly and accurately adjust the quantity of injected fuel to correct for idling speed errors. Depending upon the rotational speed of the engine, such a correction to the quantity of injected fuel can be too small, too large, or even in the wrong direction. As a result, systems using the conventional approach for fuel based idle speed control are prone to speed hunting and complete instability at certain engine idling speeds.

SUMMARY OF THE INVENTION

The present invention is directed toward providing a reliable and rapidly responding system for regulating the rotational idling speed of an internal combustion engine operating according to fuel based control strategy. Broadly, this is accomplished by providing means for sensing the actual idling speed of the engine, means for deriving a desired idling speed for the engine, and means for reducing the difference between the desired and actual idling speeds by adjusting the flow rate of the quantity of fuel delivered to the engine as a function of the difference between the desired and actual idling speeds.

Because the flow rate of fuel delivered to the engine is proportional to the quantity of fuel injected into each cylinder per engine cycle multiplied by the rotational speed of the engine, it has been found that the flow rate of quantity of fuel required to operate the engine at a given idle speed increases monotonically with increasing idling speed. As a consequence, engine idling speed can be regulated more accurately and quickly by directly adjusting the engine fuel flow rate rather than the quantity of injected fuel per cylinder per cycle, and without the idle speed instabilities generally associated with adjusting the latter parameter.

More particularly, an open-loop feedforward value for the engine fuel flow rate is determined based on the desired idling speed and the engine operating temperature. A closed-loop feedback value for the fuel flow rate is determined based upon the error in idling speed, which is equal to the difference between the desired and actual idling speeds. The engine fuel flow rate is then adjusted in accordance with the sum of the open-loop and closed-loop values, to effectuate rapid feedforward and feedback control of the engine idling speed.

According to another aspect of the invention, the idle speed regulating system can further include means for storing the value of at least one learning correction, where each learning correction value is defined as corresponding to a distinct predetermined engine operating temperature range, and means for updating the value of the stored learning correction corresponding to the predetermined temperature range embracing the operating temperature of the engine in accordance with the computed idle speed error. The flow rate of the quantity of fuel delivered to the engine is then directly adjusted based upon a sum of the open-loop value, the closed-loop value, and the learning correction value corresponding to the predetermined temperature range embracing the indicated engine operating temperature. This provides the idle speed regulation system with the ability to rapidly adapt and learn corrections associated with variations due to engine component aging, engine to engine differences, and/or changing environmental conditions.

Preferably, the updated values for a learning correction is determined in accordance with an integration of a predetermined function having a value depending upon the error in idling speed between the desired and actual idling speeds. By updating the learning correction values in this fashion, this integration provides a degree of filtering or averaging to eliminate noise from the learning process.

These and other aspects and advantages of the invention may be best understood by reference to the following detailed description of the preferred embodiments, when considered in conjunction with the accompanying drawings.

DESCRIPTION OF THE PREFERRED EMBODIMENTS

Figure 1:
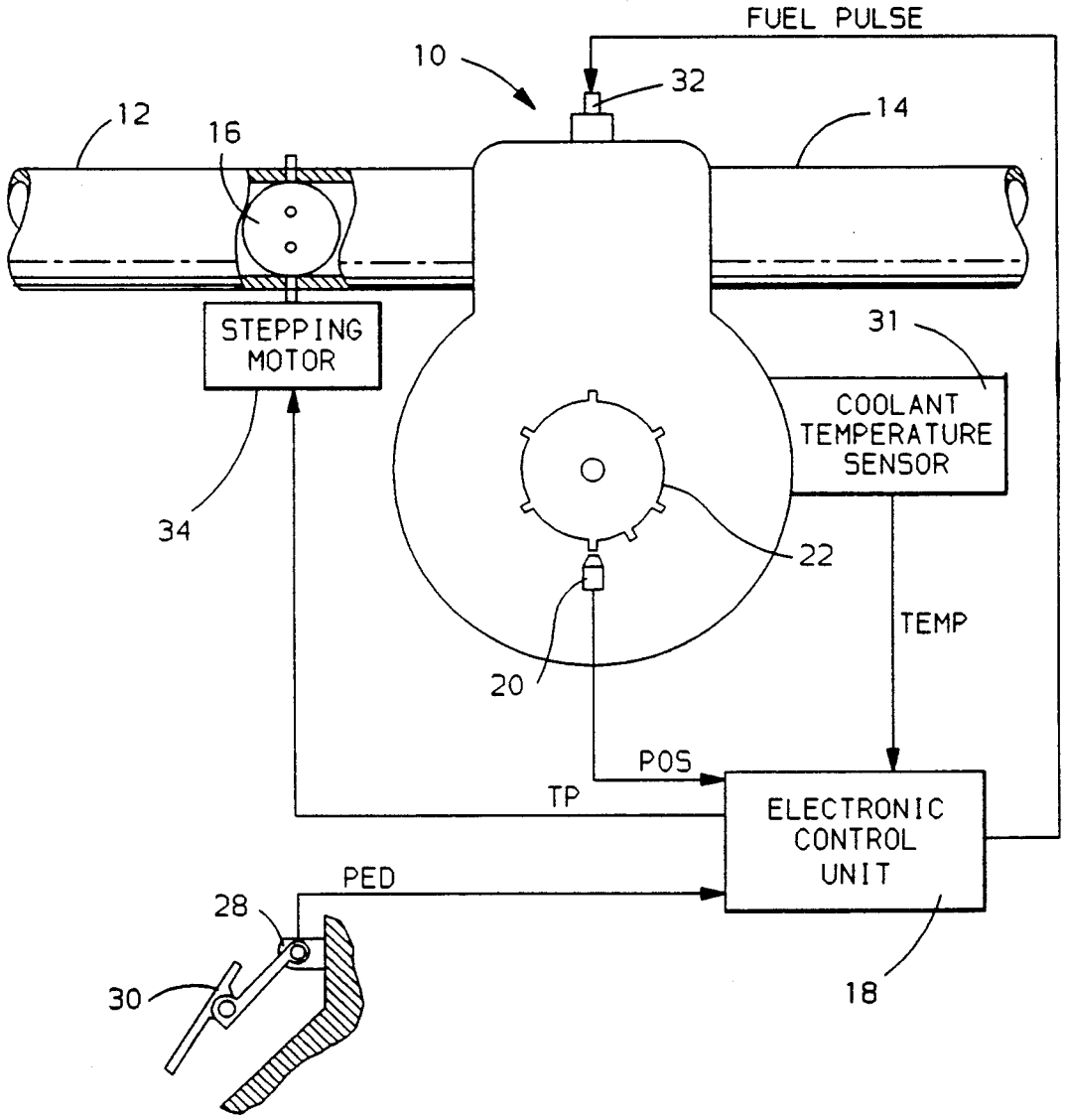
FIG. 1 schematically illustrates an internal combustion engine operating according to a fuel based control strategy and a system for regulating the idling speed of the engine in accordance with the principles of the present invention.

Referring to FIG. 1, there is shown schematically a fuel injected, internal combustion engine, generally designated as 10, with an associated intake system 12 for supplying air to the engine 10 and an exhaust system 14 for transporting combustion products away from the engine 10. A throttle valve 16 is disposed within the air intake system 12 for the purpose of regulating the quantity of air flowing into the engine 10.

The operation of engine 10 is controlled by a conventional electronic control unit (ECU) 18, which receives input signals from several standard engine sensors, processes information derived from these input signals in accordance with a stored program, and then generates the appropriate output signals to control various engine actuators.

The ECU 18 includes a central processing unit, random access memory, read only memory, non-volatile memory, analog-to-digital and digital-to-analog converters, input/output circuitry, and clock circuitry, as will be recognized by those skilled in the art of modern computer engine control.

The ECU 18 is supplied with a POS input signal that indicates the rotational position of engine 10. The POS input can be derived from a standard electromagnetic sensor 20, which produces pulses in response to the passage of teeth on wheel 22, as it is rotated by engine 10. As shown, wheel 22 can include a non-symmetrically spaced tooth, to provide a reference pulse for determining the specific rotational position of the engine 10 in its operating cycle. By counting the number of symmetrical pulses in the POS signal that occur in a specified time period, the ECU 18 determines the actual rotational speed N of engine 10 in revolutions per minute (RPM), and stores the value at a designated location in random access memory.

A standard potentiometer 28 is coupled to an accelerator pedal 30 to provide ECU 18 with a PED input signal. This PED input signal indicates the degree to which the accelerator pedal 30 is depressed in response to operator demand for engine output power. Additionally, a standard coolant temperature sensor 31 is employed to provide ECU 18 with a coolant temperature input signal TEMP, which is indicative of the operating temperature of the engine 10.

During normal engine operation (non-idling), the ECU 18 looks up a value for the quantity of fuel to be supplied to each engine cylinder from a table, which is permanently stored in the ECU read only memory as a function of the depression of the accelerator pedal 30 indicated by the PED input signal. Typically, the value obtained from the look-up table represents the pulse width of a FUEL PULSE applied to activate the electrical solenoid of an engine fuel injector 32. The duration of the FUEL PULSE, i.e. the fuel pulse width (FPW), determines the metered quantity (or mass) of fuel per cylinder (FPC) injected into the engine 10 during an engine cycle. At the appropriate rotational positions of engine 10, the ECU 18 functions in this fashion to generate the appropriate fuel pulses for each engine cylinder (only one of which is shown in FIG. 1). This is commonly referred to as a fuel based control strategy, since the depression of the accelerator pedal directly determines the quantity of injected fuel, as opposed to an air based strategy where the accelerator pedal directly controls engine air flow.

For an engine operating according to such a fuel based control strategy, feedback control is typically employed to regulate the position the engine air throttle valve 16 to achieve a desired engine air flow. For example, the ECU 18 can compute a value for the desired air mass per cylinder by multiplying the scheduled air-fuel ratio by the injected quantity of fuel per cylinder (FPC). The actual mass of air supplied to each cylinder can then be derived from a conventional mass air flow sensor (not shown), or by any other technique known in art. Using feedback control, the ECU 18 then generates a throttle position output signal TP, based upon the difference between the values for the actual and desired air mass per cylinder. This TP output signal is then applied to drive a stepping motor 34, which is mechanically coupled to air throttle valve 16, to appropriately adjust the quantity of air flowing into engine 10.

The control of air flow in fuel based systems, such as described above, is known in the art, and a more detailed description can be found, for example, in U.S. application Ser. No. 07/693105 filed Apr. 29, 1991, which is co-pending with the present application and assigned to the same assignee.

When the above-described engine operates at idle, the idling rotational speed has traditionally been regulated by adjusting the quantity of fuel injected into each cylinder during each engine cycle. Generally, this has been accomplished by applying proportional-integral-derivative (PID) control, or some variation thereof, to directly adjust the quantity of fuel injected per cylinder per cycle in accordance with the difference between the desired engine idling speed and the actual rotational speed to reduce the difference.

Figure 2:
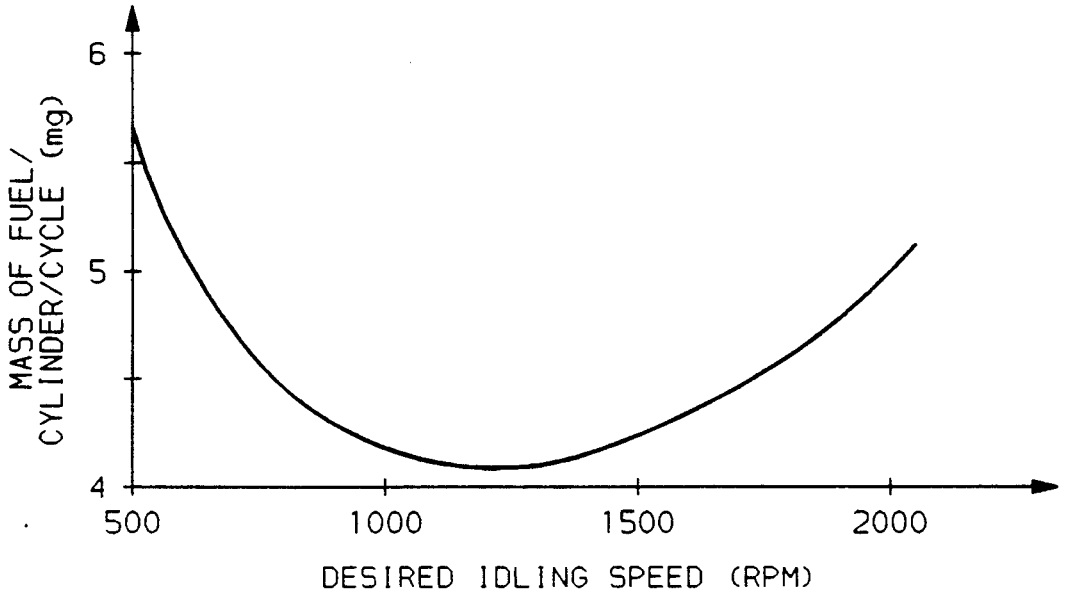
FIG. 2 graphically illustrates the non-monotonic relationship existing between the quantity of fuel injected per cylinder per cycle and engine idling speed for a representative two-stroke internal combustion engine.

In practice, this type of idle control has exhibited instability under certain engine operating conditions, and is prone to idle speed hunting. It has been found that this undesirable behavior results because of the relationship between engine idling speed and the engine parameter being adjusted, i.e. the quantity of fuel injected per cylinder per cycle. FIG. 2 graphically illustrates the variation in the quantity of fuel injected per cylinder per cycle as function of idling speed for a representative warmed-up internal combustion engine (which is a three-cylinder, two-stroke engine having a coolant temperature of at least 76° C. in the present embodiment).

The data for the graph presented in FIG. 2 was obtained by measuring the idling speed of the engine while varying the quantity of injected fuel as the engine was operated on a conventional dynamometer. As shown, the quantity of fuel injected per cylinder per cycle does not behave monotonically with respect to the engine rotational speed. At low engine speeds, the quantity of fuel required to be injected into each cylinder to sustain a given idling speed initially decreases with increasing engine idling speed. This is due to the improved thermal efficiency and scavenging of the engine as rotational speed increases. Eventually frictional losses in the engine rise to the point where quantity of injected fuel per cylinder must be increased to maintain higher idling speeds.

Because of this non-monotonic behavior, traditional idle control systems are unable to accurately regulate idle speed by directly making adjustments to correct the quantity of fuel that is injected into each cylinder. At different engine speeds, these corrections can be too small, too large, or even in the wrong direction. As a result, idle speed control systems using this approach are prone to speed hunting and instability at certain engine operating speeds.

Figure 3:
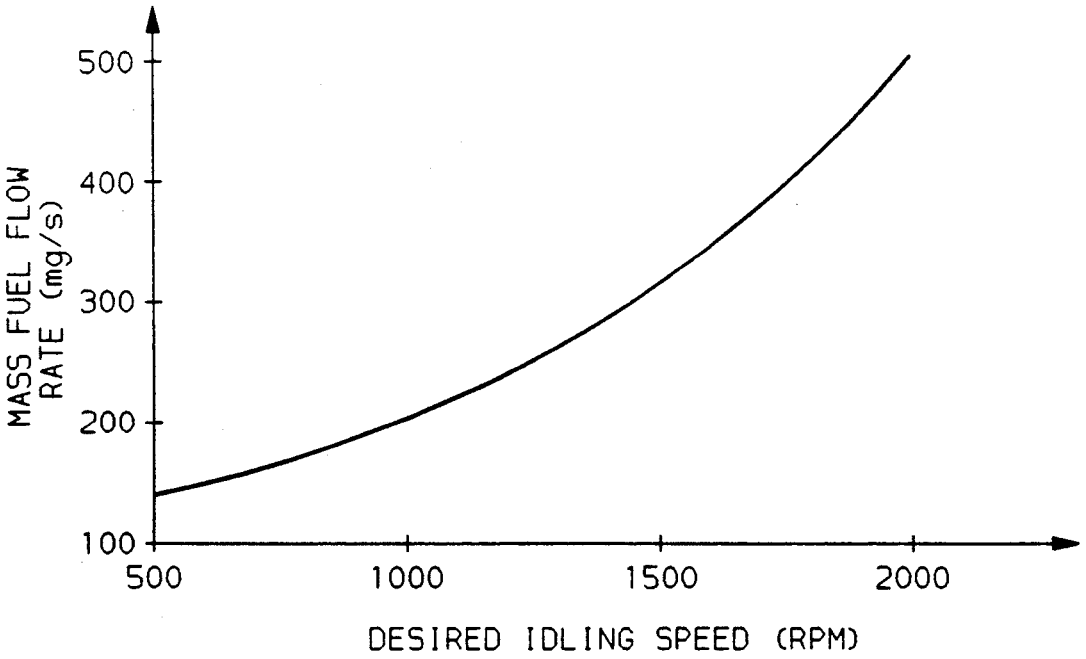
FIG. 3 graphically illustrates the monotonic behavior of the mass flow rate of fuel with respect to engine idling speed for the same two-stroke engine employed in obtaining the data depicted in FIG. 2.

In ascertaining the reasons for the unstable behavior of the conventional systems for regulating idle speed, the applicants recognized that a different engine parameter, the flow rate of the quantity of fuel delivered to the engine, behaves monotonically with variations in engine idling speed. FIG. 3 graphically illustrates the change in idling speed produced by varying the flow rate of the mass of fuel (mg/s) delivered to the same two-stroke engine used for obtaining the data depicted in FIG. 2. Note that the fuel mass flow rate increases monotonically with increasing engine speed since it is proportional to the quantity of fuel injected per cylinder per cycle (see FIG. 2) multiplied by the rotational speed of the engine. More particularly, the fuel mass flow rate (in mg/s) at a particular idling speed can be obtained by multiplying the corresponding quantity of fuel injected per cylinder cycle (in mg) from FIG. 2 by the engine speed (in RPM), and then multiplying that result by a constant, where the constant has a value equal to 1/60 times the number of cylinders receiving fuel during one complete revolution of the engine. For the present case of a three cylinder, two-stroke engine, the constant would be equal to 1/20.

Because fuel mass flow rate varies in a monotonic fashion with engine speed, it has been found that idling speed can be regulated more accurately and reliably by directly adjusting the mass rate of flow of fuel delivered to the engine, rather than the quantity of fuel injected per cylinder per cycle. Broadly then, the present invention is directed toward an improved system for regulating the idling speed of an internal combustion engine utilizing a fuel based control strategy, which includes: (1) means for measuring the actual idling speed of the engine; (2) means for determining a desired idling speed for the engine; and (3) means for reducing the difference between the desired and actual engine idling speed by adjusting the flow rate of the quantity of fuel delivered to the engine as a function of the difference between the desired and actual engine idling speeds.

In what follows, the mass flow rate will be used whenever referring to the flow rate of the quantity of fuel delivered to the engine. However, it will be recognized by those skilled in the art that the volumetric flow rate for the fuel behaves equivalently, and could just as easily be adjusted to achieve improved idle speed regulation in accordance with the principles of the present invention.

Figure 4A:
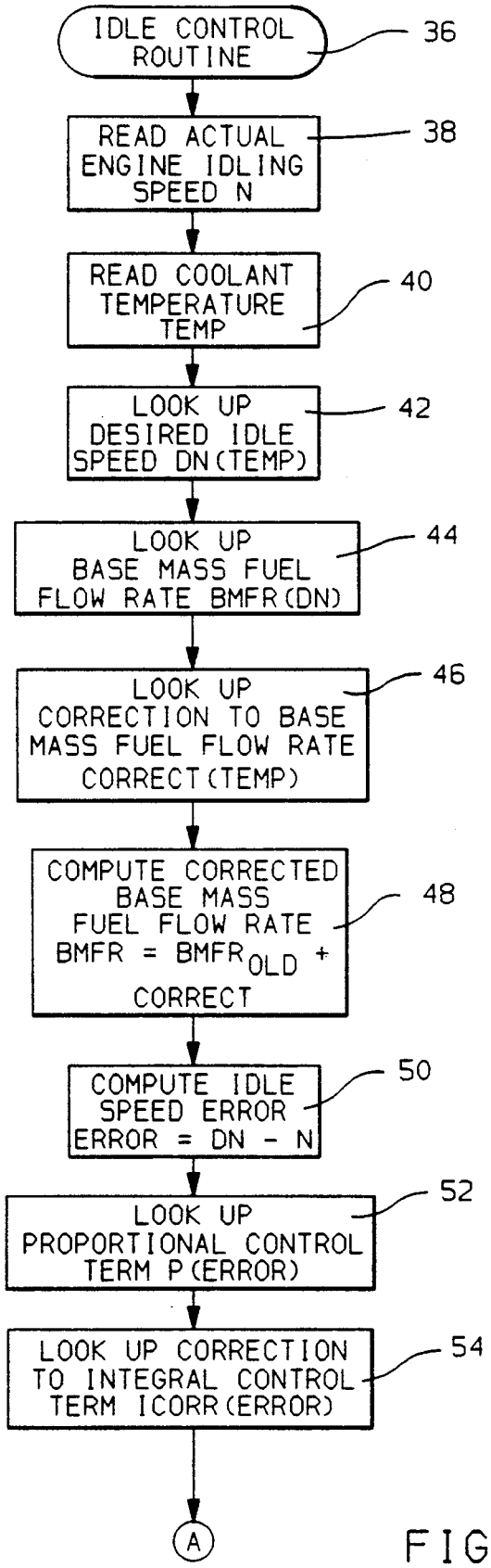
FIGS. 4A and 4B present portions of a flow diagram representative of the steps executed by the electronic control unit in FIG. 1, when adjusting the flow rate of the quantity of fuel delivered to the engine to regulate idling speed in accordance with the principles of the present invention.
Figure 4B:
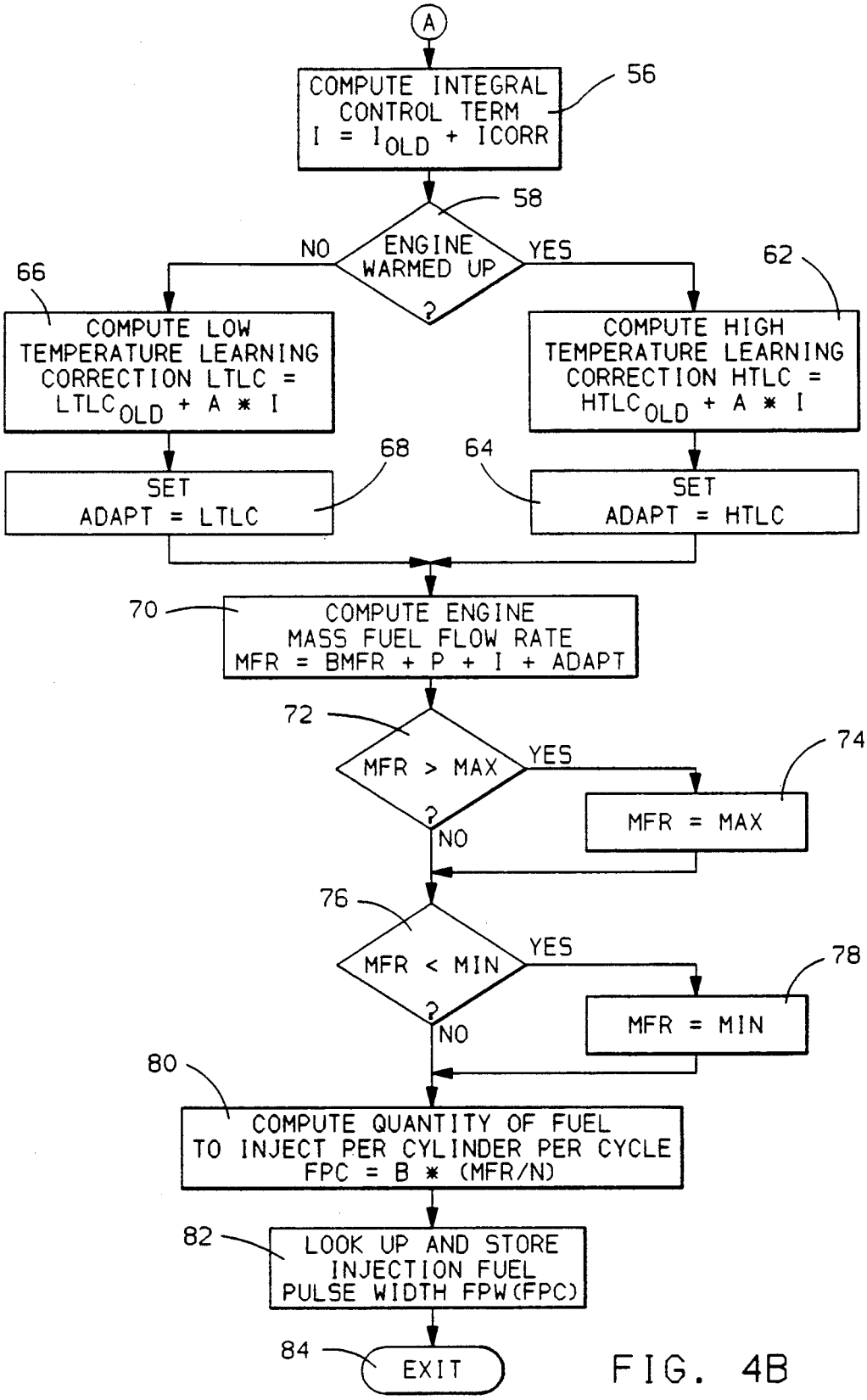

Referring now to FIGS. 4A and 4B, there is illustrated a flow diagram representative of the steps executed by ECU 18 in regulating engine idling speed in accordance with the principles of the present invention. At the time engine 10 is started, all of counters, flags, registers, timers, and the appropriate variables stored in memory locations within the ECU 18 are set to suitable initial values. The IDLE CONTROL ROUTINE shown in FIGS. 4A and 4B is then executed as part of a main fuel based engine control program, whenever the ECU 18 senses that engine 10 is operating in the idling mode.

Conventionally, operation of engine 10 in the idling mode is detected when the PED input signal indicates that the accelerator pedal 30 is not depressed, along with either the engine speed and/or vehicle speed being less than a predetermined minimum value. Normally, the ECU 18 is provided with an input signal representing vehicle speed from a standard transmission speed sensor (not shown), although any other known means for acquiring vehicle speed could also be employed.

When engine 10 is determined to be operating at idle, the IDLE CONTROL ROUTINE is entered at point 36 and is executed during each pass through the main engine control routine (in the present embodiment this occurs at approximately 40 millisecond time intervals). From point 36, the routine proceeds to step 38.

At step 38, the routine reads the value of the actual engine idling speed denoted as N, which is derived from the POS input signal, as previously described, and stored in the random access memory of ECU 18. Typically, this value for the engine speed is computed by averaging the measured engine speed values over one or more complete engine revolutions.

Next at step 40, the the routine reads the value of the coolant temperature indicated by the input signal TEMP, and stores the value in a corresponding variable designated as TEMP in random access memory.

Figure 5:
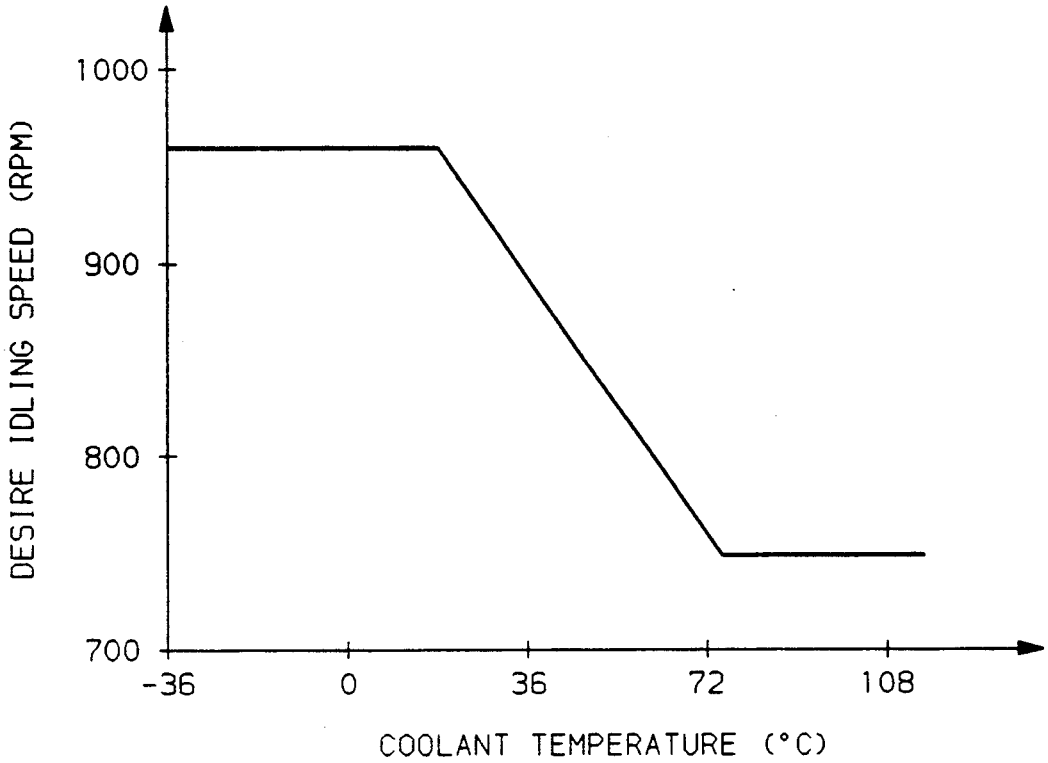
FIG. 5 graphically illustrates representative values for the desired idling speed of an engine as a function of the engine coolant temperature.

At step 42, a value for the desired idling speed for the engine, which is designated as the variable DN, is looked up in a table permanently stored in the read only memory of ECU 18 as a function of the coolant temperature indicated by TEMP. Typical table values for the desired engine idling speed as a function of coolant temperature are presented graphically is FIG. 5. As is customary, the desired idling speed is set high when the engine is cold to avoid stalling and then decreases as the engine warms-up.

Next, the routine proceeds to step 44 where a base value for the fuel mass flow rate (designated as BMFR) is looked up in a table permanently stored in memory as a function of the desired engine idling speed DN. Typical values for the base fuel mass flow rate table for different desired idling speeds were presented previously in FIG. 3 for a completely warmed-up engine (i.e., when the coolant temperature is above 76° C. in the present embodiment).

Figure 6:
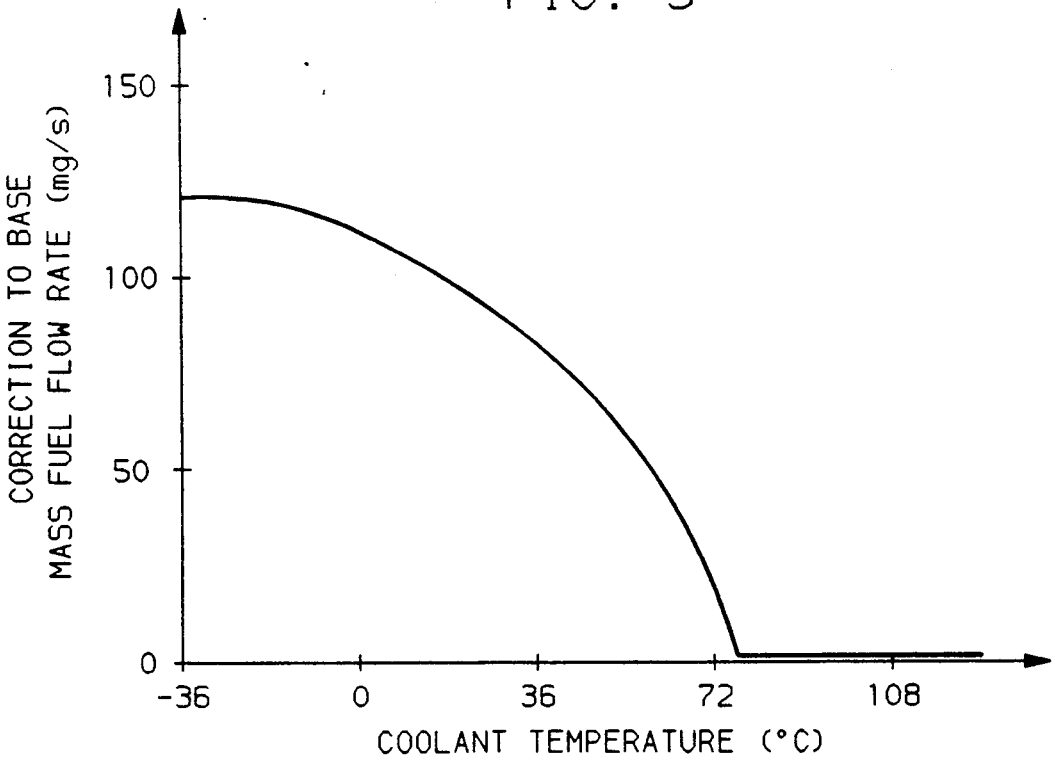
FIG. 6 graphically illustrates representative correction values for increasing fuel mass flow rate as a function of engine coolant temperature during engine warm-up.

Next at step 46, a correction to the base mass fuel flow rate designated as CORRECT is looked up in an additional table permanently stored in read only memory as a function of the coolant temperature indicated by TEMP. Representative table values for CORRECT are shown by the graph presented in FIG. 6, and can be obtained by measuring the required increase in the base value of the fuel mass flow rate (as provided in FIG. 3) necessary to achieve a desired idling speed when the engine is not fully warmed-up.

Then at step 48, a new temperature corrected value for the base mass fuel flow rate BMFR is computed by adding the value of CORRECT found at step 46 to $BMFR_{OLD}$, which represents the previous or old value for base mass fuel flow rate found at step 44. Note that the steps 44 through 48 could be replaced by a single step, where the base mass fuel flow rate would be looked up in a single two-dimensional table as a function of values for the desired idling speed DN and the coolant temperature TEMP.

The routine then passes to the next step 50, where a value for ERROR, the idle speed error, is computed by subtracting the actual rotational idling speed N from the desired idling speed DN.

Figure 7:
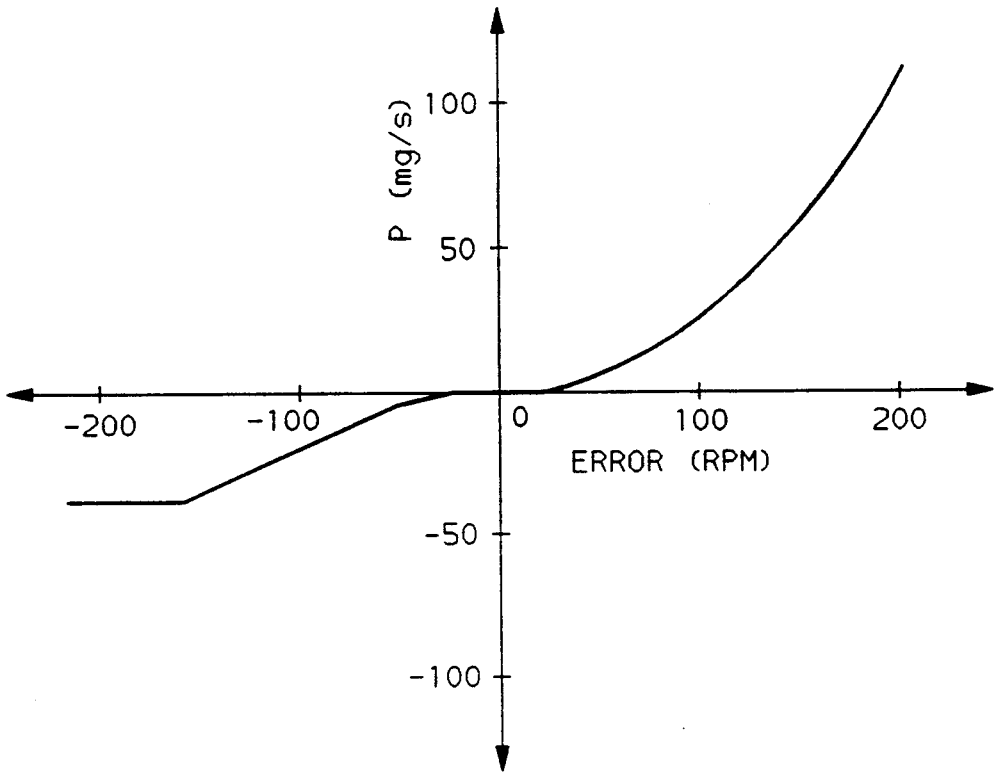
FIG. 7 graphically illustrates representative values for a proportional control term used for adjusting engine mass fuel flow rate based upon the error in speed between the desired and actual engine idling speeds.

Next at step 52, a proportional feedback control term designated as P is looked up in a permanently stored table as a function of the computed idle speed ERROR term. Representative values for the proportional control term P as a function of ERROR are illustrated in FIG. 7.

Figure 8:
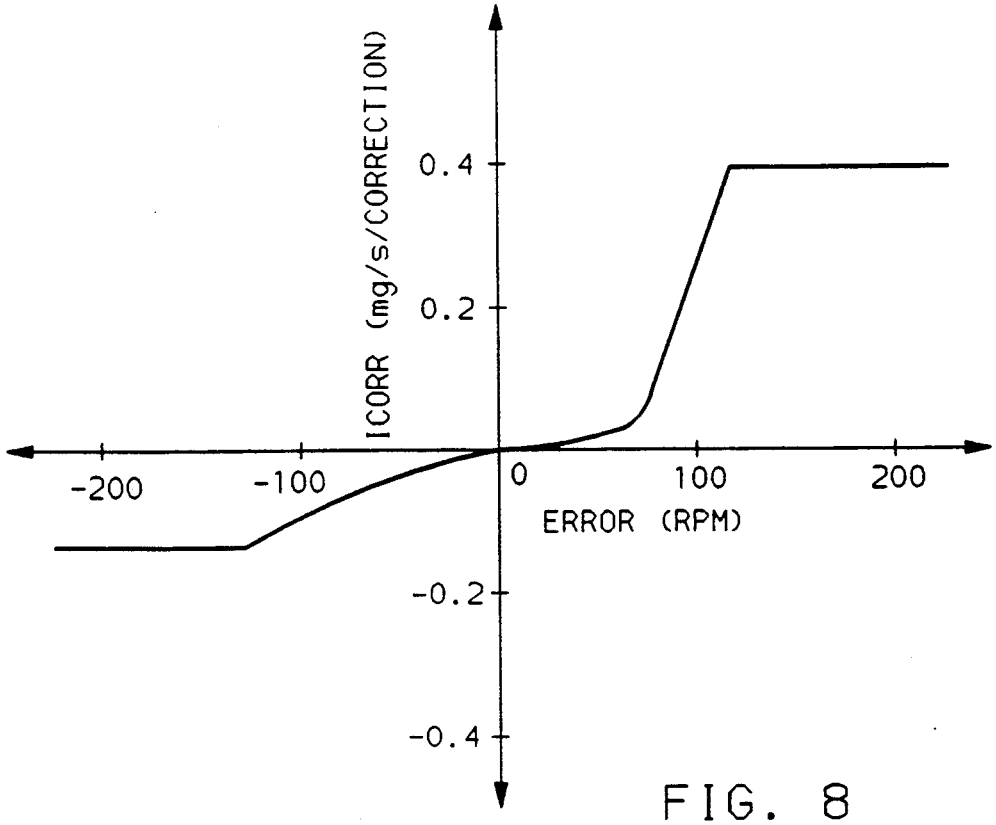
FIG. 8 graphically illustrates representative values for a correction to an integral control term used for adjusting the engine mass fuel flow rate based upon the engine idle speed error.

After completing step 52, the routine proceeds to step 54, where an integral correction designated as ICORR is looked up in a permanently stored table as a function of the idle speed ERROR. Representative table values for this integral correction term in units of milligrams per second per CORRECTION are illustrated in FIG. 8. A CORRECTION occurs each time the IDLE CONTROL ROUTINE is executed, which correspond to approximately 40 millisecond intervals in the present embodiment.

This value for ICORR is then used at step 56 to obtain a new value for an integral feedback control term designated as I. The new value for I is computed by adding the correction term ICORR to the previous or old value of the integral control term, which is designated as $I_{OLD}$ (note that the value of I would be initialized to zero at the time of engine starting). Since the correction term ICORR is a predetermined function depending upon the idle speed ERROR (see FIG. 8), and the ICORR term is added to the integral term I each time the IDLE CONTROL ROUTINE is executed (one CORRECTION approximately every 40 milliseconds), the integral term I then represents a running summation or integration of a predetermined function ICORR, which depends upon the idle speed ERROR.

Next at step 58, a decision is required as to whether the engine is in the process of warming-up or is in a completely warmed up state. To accomplish this, the engine idling mode is partitioned into two distinct operating temperature ranges, one range where the coolant temperature indicates the engine operating temperature is above a predetermined warm-up temperature, and another range where the coolant temperature indicates the engine operating temperature is less than or equal to the predetermined warm-up temperature. As previously pointed out, the coolant temperature of 76° C. was selected as the predetermined engine warm-up temperature in the present embodiment. It will be recognized that this particular temperature may vary in different engine applications depending on, for example, the particular thermostat employed in the engine coolant system.

For the present embodiment, the decision required at step 58 is then made by comparing the coolant temperature indicated by TEMP with the selected warm-up temperature of 76° C. If TEMP exceeds 76° C. the engine is considered to be completely warmed-up and the routine proceeds to step 62. If TEMP does not exceed 76° C., the engine is considered to be in the warming-up stage, and the routine then proceeds to step 66.

In the presently described embodiment, two learning correction variables are assigned specific memory locations in the non-volatile memory of ECU 18. The first is a high temperature learning correction designated as HTLC, which is defined to correspond to the completely warmed-up engine temperature range for idling operation (i.e. TEMP>76° C.). The second is a low temperature learning correction designated as LTLC, which is defined to correspond to the temperature range for a warming-up engine operating at in the idling mode (i.e. TEMP≦76° C.).

If the engine is judged to be completely warmed-up at step 58, the routine passes to step 62, where a new or updated value for the high temperature learning correction HTLC is computed according to:

$$HTLC = HTLC_{OLD} + A*I. \quad (1)$$

where $HTLC_{OLD}$ represents the old or previous value for the high temperature learning correction, and the term A*I is obtained by multiplying the integral control term I from step 56 by a predetermined constant A having a value of less than one (for example, A=0.1). Thereafter, the routine passes to step 64, where a general learning correction variable designated as ADAPT is set equal to the updated value of the high temperature learning correction HTLC computed at step 62.

When the engine is determined not to be completely warmed-up at step 58, the routine then proceeds to step 66, where a new or updated value for the low temperature learning correction LTLC is computed according to: overall $$LTLC = LTLCOLD + A*I. \quad (2)$$

where $LTLC_{OLD}$ represents the old or previous value for the low temperature learning correction, and the term A*I is obtained by multiplying the integral control term I from step 56 by the same constant A used in step 62. Thereafter, the routine passes to step 68, where the general learning correction ADAPT is set equal to the updated value for the low temperature learning correction.

Those skilled in the control art will recognize that the updating of the learning corrections HTLC and LTLC at steps 62 and 66 could be carried out in a number of different ways in accordance with the idle speed error (recall that the value of I depends upon the idle speed error). Instead of updating the previous values of HTLC and LTLC by adding a fixed portion of the integral correction term I (i.e., A*I), a fixed constant could be added or subtracted based on the respective sign of the integral I term, at predetermined updating intervals. For example, a constant such as 0.1 mg/s could be added to or subtracted from the previous values of HTLC and LTCT, when the sign of integral term I is positive or negative, respectively. With this type of updating, counters would typically be employed just prior to each of steps 62 and 66 to limit such updating to an interval such as 0.4 seconds to permit sufficient time for the value of the integral term to stabilize when engine operating conditions change.

From either step 64 or step 68, the routine proceeds to step 70, where a value for the engine mass fuel flow rate designated as MFR is computed according to:

$$MFR = BMFR + P + I + ADAPT. \quad (3)$$

This value for MFR represents the estimated fuel flow rate computed by the present embodiment that will reduce the idle speed ERROR to zero and bring the engine to the desired idling speed. Those skilled in the engine control art will recognize that the partial sum of the proportional and integral feedback terms (P +I) computed at step 70 as the closed-loop value used in conventional proportional-integral feedback control schemes in automotive applications.

Next at step 72, the value for the fuel mass flow rate MFR is compared with a maximum permissible value designated as MAX, and if the value of MFR exceeds MAX, it is set equal to MAX at step 74, before proceeding to the next step 76.

At steps 76, the value for the fuel mass flow rate is compared with a minimum permissible value designated by MIN, and if the value of MFR is less than MIN, it is set equal to MIN at step 78, before proceeding to the next step 80.

The MAX and MIN values employed in steps 72 through 78 are, respectively, the maximum and minimum flow rates at which fuel can be delivered to the engine without exceeding the operable limits of the fuel injectors 32.

Next at step 80, the fuel mass flow rate MFR computed at step 70 is converted into the corresponding FPC value in mg representing the quantity of fuel to be injected into each engine cylinder during an engine cycle. This is accomplished by utilizing the relationship:

$$FPC = B * (MFR/N). \quad (4)$$

where N is the desired idling speed of the engine in RPM and B is a constant equaling 20 for the three-cylinder, two-stroke engine used in describing the present embodiment.

Then at step 82, a value for the fuel injector pulse width or FPW is looked up in a table stored in read only memory as a function of the fuel per cylinder per cycle FPC computed at step 80. The values for the table are the same as those used for converting fuel per cylinder per cycle to fuel pulse width in the conventional non-idling portion of the fuel based engine control system. This computed value for the fuel pulse width FPW is stored at its designated location in random access memory, and thereafter, is used by the main engine control program in adjusting the pulse width of each FUEL PULSE directed to a fuel injector 32, so that the mass flow rate of the fuel delivered to the idling engine correspond to the value of MFR computed at step 70. After the completion of step 82, the routine exits at point 84.

In summary, for the above described embodiment of the present invention provides for: (1) sensing the actual idling rotational speed N of the engine; (2) deriving an indication of the engine operating temperature TEMP; (3) deriving a desired idling speed DN for the engine in accordance with the indicated engine operating temperature TEMP; (4) computing an idle speed ERROR based upon the difference between the desired and actual idling speeds (DN−N); (5) determining an open-loop value BMFR for controlling the flow rate of the quantity of fuel delivered to the engine based upon desired idling speed DN and the indicated engine operating temperature TEMP; (6) determining a closed-loop value (P+I) for controlling the flow rate of the quantity of fuel delivered to the engine based upon the computed idle speed ERROR; (7) storing at least one learning correction value in a memory (HTLC and LTLC), where each learning correction value is defined as corresponding to a distinct predetermined engine operating temperature range (HTLC corresponding to TEMP >76° C. and LTLC corresponding to TEMP≦76°); (8) updating the value of the stored learning correction (HTLC or LTLC) corresponding to the predetermined temperature range embracing the indicated engine operating temperature TEMP, the value of the stored learning correction being updated in accordance with the computed idle speed ERROR; (9) and reducing the idle speed ERROR by adjusting the rate of flow of the quantity of fuel delivered to the engine MFR in accordance with a sum of the open-loop value BMFR, the closed-loop value (P+I), and the learning correction value corresponding to the predetermined temperature range embracing the indicated engine operating temperature (ADAPT set equal to either HTLC or LTLC based on the value of TEMP).

More particularly, as will be recognized by those skilled in the control art, the open-loop value BMFR and the closed-loop value (P+I) provide for accurate and rapid feedforward and feedback control of the engine idling speed, respectively, by the appropriate adjustment of the fuel mass flow rate. In addition, the learning correction ADAPT provides the system with the ability to rapidly adapt and learn corrections associated with variations due to engine component aging, engine to engine differences, and/or changing environmental conditions.

More particularly, the values for the two learning corrections HTLC and LTLC in the present embodiment are updated based upon the integral control term I, which is obtained by integrating the predetermined function ICORR that has a value depending upon the speed ERROR (see FIG. 8). By updating the learning correction values in this fashion, the integration provides a degree of filtering or averaging to eliminate noise from the learning process.

In the above described embodiment of the invention, two separate learning corrections were employed. The high temperature learning corrections HTLC was selected to correspond to a range of engine operating temperature representing the completely warmed-up state for an idling engine. The low temperature learning correction LTLC was selected to correspond to a range of engine operating temperature representing the warming-up state of an idling engine. This provides the system with the ability to adaptively learn corrections for engine operation in both a warming-up state and a completely warmed-up state, and requires only two storage locations in the non-volatile memory of the ECU 18.

It should be recognized that other embodiments having differing numbers of learning corrections and corresponding ranges of temperature are possible. For example, a single non-volatile memory location could be used to store a single learning correction value, which is selected to correspond to a completely warmed-up engine. Alternatively, one learning correction could be selected to correspond to the warmed-up state of an idling engine, and several additional learning corrections could be selected to correspond to different temperature ranges for the warming-up state during engine idling. For a given application, the number of selected learning corrections will depend upon the availability of space in the non-volatile memory and the degree of improvement in idle speed regulation achieved by the use of additional learning corrections and partitioning of the engine idling temperature range into additional corresponding temperature ranges.

As an alternative embodiment, the present invention may also be practiced without employing any adaptive learning feature. This can be accomplished, for example, by modifying the IDLE CONTROL ROUTINE to eliminate steps 58 through 68 related to the learning correction values, and modifying step 70 to remove the general learning correction ADAPT from the summation providing the value for the mass fuel flow rate MFR. Consequently, in this alternative embodiment, the engine idling speed would be regulated by adjusting the flow rate of the quantity of fuel delivered to the engine in accordance with the sum of the open-loop value and the closed-loop value, without any learning correction value. The open-loop and closed-loop values would still provide feedforward and feedback control of the idling speed, but the system would lack the ability to learn corrections associated with engine to engine variations, component aging, and changing environmental conditions.

In the above description, the closed-loop value was obtained by summing a proportional control term and an integral control term. It will be recognized by those skilled in the control art that the closed-loop value could also include a derivative control term, in accordance with classical PID control techniques. In the preferred embodiment, a derivative control term was not included in the closed-loop feedback value because idle speed regulation was found to be satisfactory without its use.

Although the particular engine used in describing the present invention was a two-stroke engine, four-stroke engines behave similarly with respect to the non-monotonic behavior of the quantity of injected fuel required to sustain a given idling speed. Consequently, the invention can also be applied to improve the regulation of idling speed in four-stroke engines operating according to a fuel based control strategies.

The aforementioned description of the preferred embodiments of the invention is for the purpose of illustrating the invention, and is not to be considered as limiting or restricting the invention, since many modifications may be made by the exercise of skill in the art without departing from the scope of the invention.

The embodiments of the invention in which an exclusive property or privilege is claimed are defined as follows:

1. A system for regulating the rotational speed of an internal combustion engine operating in an idling mode, the engine including means for delivering a quantity of air and a quantity of fuel for combustion, wherein the quantity of delivered air is determined in response to the quantity of delivered fuel to achieve a desired air-fuel ratio, the system comprising:

means for sensing the actual idling rotational speed of the engine;

means for deriving a desired idling speed for the engine;

means for reducing the difference between the desired idling speed and the actual idling speed by adjusting the flow rate of the quantity of fuel delivered to the engine as a function of the difference between the desired and actual idling speeds.

2. A system for regulating the rotational speed of an internal combustion engine operating in an idling mode, the engine including means for delivering a quantity of air and a quantity of fuel for combustion, wherein the delivered quantity of air is determined in response to the delivered quantity of fuel to achieve a scheduled air-fuel ratio, the system comprising:

means for sensing the actual idling rotational speed of the engine;

means for deriving an indication for the engine operating temperature;

means for deriving a desired idling speed for the engine in accordance with the indicated engine operating temperature;

means for computing an idle speed error based upon the difference between the desired and actual idling speeds;

means for determining an open-loop value for controlling the flow rate of the quantity of fuel delivered to the engine based upon desired idling speed and the indicated engine operating temperature;

means for determining a closed-loop value for controlling the flow rate of the quantity of fuel delivered to the engine based upon the computed idle speed error;

means for reducing the idle speed error by adjusting the flow rate of the quantity of fuel delivered to the engine in accordance with the sum of the open-loop value and the closed-loop value.

3. A system for regulating the rotational speed of an internal combustion engine operating in an idling mode, the engine including means for delivering a quantity of air and a quantity of fuel for combustion, wherein the delivered quantity of air is determined in response to the delivered quantity of fuel to achieve a scheduled air-fuel ratio, the system comprising:

means for sensing the actual idling rotational speed of the engine;

means for deriving an indication for the engine operating temperature;

means for deriving a desired idling speed for the engine in accordance with the indicated engine operating temperature;

means for computing an idle speed error based upon the difference between the desired and actual idling speeds;

means for determining an open-loop value for controlling the flow rate of the quantity of fuel delivered to the engine based upon desired idling speed and the indicated engine operating temperature;

means for determining a closed-loop value for controlling the flow rate of the quantity of fuel delivered to the engine based upon the computed idle speed error;

means for storing at least one learning correction value in a memory, where each learning correction value is defined as corresponding to a distinct predetermined engine operating temperature range;

means for updating the value of the stored learning correction corresponding to the predetermined temperature range that embraces the indicated engine operating temperature, the updated value being determined in accordance with the computed idle speed error;

means for reducing the idle speed error by adjusting the rate of flow of the quantity of fuel delivered to the engine in accordance with a sum of the open-loop value, the closed-loop value, and the learning correction value corresponding to the predetermined temperature range embracing the indicated engine operating temperature.

4. The system described in claim 3, wherein the updated value of the learning correction is determined in accordance with the integration of a predetermined function having a value depending upon the idle speed error.

* * * * *